US008926034B2

(12) United States Patent
Park

(10) Patent No.: US 8,926,034 B2
(45) Date of Patent: Jan. 6, 2015

(54) REFRIGERATOR

(75) Inventor: Jinwook Park, Changwon (KR)

(73) Assignee: LG Electronics Inc., Seoul (KR)

( * ) Notice: Subject to any disclaimer, the term of this patent is extended or adjusted under 35 U.S.C. 154(b) by 1017 days.

(21) Appl. No.: 13/003,928

(22) PCT Filed: Jun. 8, 2009

(86) PCT No.: PCT/KR2009/003051

§ 371 (c)(1),
(2), (4) Date: Mar. 18, 2011

(87) PCT Pub. No.: WO2010/008141

PCT Pub. Date: Jan. 21, 2010

(65) Prior Publication Data

US 2011/0174012 A1 Jul. 21, 2011

(30) Foreign Application Priority Data

Jul. 14, 2008 (KR) ..... 10-2008-0067949
Feb. 13, 2009 (KR) ..... 10-2009-0012016

(51) Int. Cl.
*A47B 96/04* (2006.01)
*F25D 25/02* (2006.01)
*A47B 96/02* (2006.01)

(52) U.S. Cl.
CPC ..... *F25D 25/02* (2013.01); *A47B 96/025* (2013.01); *A47B 96/027* (2013.01); *F25D 2323/021* (2013.01)
USPC ..... 312/408; 108/102; 108/108

(58) Field of Classification Search
CPC ..... A47B 96/025; F25D 25/02; F25D 25/024; F25D 2325/021
USPC ..... 108/102, 106–110; 312/408, 410
See application file for complete search history.

(56) References Cited

U.S. PATENT DOCUMENTS

| | | | | | |
|---|---|---|---|---|---|
| 2,692,813 | A * | 10/1954 | Toronto | 312/408 |
| 2,830,864 | A * | 4/1958 | Pulaski | 312/305 |
| 5,454,638 | A * | 10/1995 | Bird et al. | 312/408 |
| 5,813,741 | A * | 9/1998 | Fish et al. | 312/408 |
| 8,167,390 | B2 * | 5/2012 | Koo et al. | 312/408 |
| 8,376,483 | B2 * | 2/2013 | Jung | 312/408 |
| 8,414,095 | B2 * | 4/2013 | Stewart | 312/408 |
| 8,640,482 | B2 * | 2/2014 | Lim et al. | 62/340 |
| 8,651,600 | B2 * | 2/2014 | Cheong et al. | 312/408 |

(Continued)

FOREIGN PATENT DOCUMENTS

| | | | |
|---|---|---|---|
| EP | 0 679 848 | A1 | 11/1995 |
| KR | 10-0152813 | B1 | 11/1998 |
| KR | 10-2005-0120047 | A | 12/2005 |
| KR | 10-0667983 | B1 | 1/2007 |

*Primary Examiner* — Hanh V Tran
(74) *Attorney, Agent, or Firm* — Birch, Stewart, Kolasch & Birch, LLP

(57) ABSTRACT

A refrigerator includes a body having a storage space for keeping food at low temperature, a door movably attached to the body to selectively open and close the storage space, a first shelf movably provided in the storage space and having a first side surface, a second shelf movably provided in the storage space next to the first shelf and having a second side surface which faces the first side surface of the first shelf, a first pressing portion including a plurality of protrusions formed on the first side surface of the first shelf, and a second pressing portion formed on the second side surface of the second shelf and facing the first pressing portion.

9 Claims, 7 Drawing Sheets

(56) References Cited

U.S. PATENT DOCUMENTS

| | | | | |
|---|---|---|---|---|
| 2003/0020387 | A1 | 1/2003 | Wing et al. | |
| 2003/0117051 | A1 | 6/2003 | Kweon | |
| 2006/0097613 | A1* | 5/2006 | Lee et al. | 312/408 |
| 2007/0176528 | A1* | 8/2007 | Lee et al. | 312/408 |
| 2007/0228909 | A1* | 10/2007 | Hwang et al. | 312/408 |
| 2008/0034778 | A1* | 2/2008 | Lim et al. | 62/340 |

* cited by examiner

REFRIGERATOR

BACKGROUND

1. Field of the Invention

An embodiment relates to a refrigerator.

2. Description of the Related Art

In general, refrigerators are apparatuses for store food at low temperature and manufacture to keep food in freezing or cold storage in accordance with the kinds of food to store.

The inside of a refrigerator is cooled by cold air continuously supplied and the cold air is continuously produced by heat transfer of refrigerant during a refrigeration cycle composed of compression-condensation-expansion-evaporation. further, the cold air supplied inside the refrigerator uniformly disperse throughout the inside of the refrigerator by convection such that food can be stored at desired temperature in the refrigerator.

The body of the refrigerator is a rectangular parallelepiped with the front open, and a freezing compartment and a cold compartment are defined in the body. Further, a cold compartment door and a freezing compartment door are provided at the front of the body to selectively open/close the opening.

Further, a plurality of drawers, shelves, and boxes are provided in the storage space in the refrigerator to keep a variety of food in an optimal condition. In addition, a plurality of baskets is attached to the rear of the doors. The storage space in the refrigerator is divided by the shelves, boxes, and baskets, such that food can be appropriately stored.

In this configuration, when the width of the storage space is large, two shelves can be transversely disposed in parallel. Further, the shelves may slide forward to easily put in/out the food. Further, hooks may be formed at the rear end of the shelves such that the height of the shelves can be easily adjusted, such that the hooks are inserted in holders formed on the rear wall of the storage space.

However, the related art described above has the following problems.

The left and right shelves are manufactured by the same process. However, there may be small differences in dimensions of the parts due to various causes, such as errors in the process, even if they undergo the same process. Further, the inner case defining the inner wall of the body requires a foaming process and the dimension may be changed by the degree of foaming. In this configuration, since the shelves are fixed to holders on the inner case, the change in dimension of the inner case may influence the position of the shelves.

A gap difference is formed between the shelves due to the reasons described above, even though the shelves that have undergone the same process are transversely arranged in parallel. In detail, there may be an height difference between the tops of the shelves transversely arranged, a gap difference in which the gap between the fronts and the rears of two surfaces of adjacent shelves, and a front-rear difference in which the distance from the rear wall of the storage space to the fronts of the shelves.

It becomes difficult to keep and support the food simultaneously with the left and right shelves due to the differences. In detail, the food may inclines to a side, when being placed where there is a difference. In this case, larger load is applied to one shelf, such that the shelf may sags down and deform.

Further, there is interference between the left and right shelves due to the difference when sliding the shelves, such that one shelf cannot normally slide in/out.

Further, the difference detracts from the aesthetic appearance, such that users' satisfaction for the product is deteriorated.

SUMMARY

Embodiments provide a refrigerator removing differences between transversely adjacent shelves.

Further, embodiments provide a refrigerator preventing the food on the shelves from inclining.

Further, embodiments provide a refrigerator allowing the shelves to smoothly slide in/out.

Further, embodiments provide a refrigerator having good aesthetic appearance by uniformly arranging the shelves.

An embodiment provides a refrigerator including: a body having a storage space for keep food at low temperature; a door movably attached to the body to selectively open/close the storage space; and a plurality of shelves provided continuously in parallel in the storage space and sliding out forward, in which a protrusion is formed at any one surface of two surfaces facing each other of the shelves, a receiving portion receiving at least a portion of the protrusion is formed at the other surface, and the protrusion and the receiving portion are separated when any one of the adjacent shelves slides.

Another embodiment provides a refrigerator including: a body having a storage space for keep food at low temperature; a door pivotably attached to the body to selectively open/close the storage space; a first shelf provided at the left side to place food in the storage space; a second shelf provided at the right side of the storage space, with the top in the same plane as the top of the first shelf; a protrusions formed at any one of the first shelf and the second shelf; and a receiving portion formed at the other one of the first shelf and the second shelf to face the protrusion such that the protrusions is fitted, in which the protrusion and the receiving portion push each other.

Another embodiment provides a refrigerator including: a body having a storage space for keep food at low temperature; a door movably attached to the body to selectively open/close the storage space; a plurality of shelves provided continuously in parallel in the storage space and sliding out forward; side holders attached to both sides of the rear wall of the storage space and having side connecting grooves where the outer rear ends are connected; and a center holder disposed between the side holder, having center connecting grooves where the inner rear ends of the shelves are connected, closer to the rear wall of the storage space than the side connecting grooves, wherein a first pressing portion is formed at any one surface of two surfaces facing each other of the shelves, a second pressing portion receiving at least a portion of the first pressing portion is formed at the other surface of two surfaces facing each other of the shelves.

Another embodiment provides a refrigerator including: a body; an inner case defining the inner sides of the body and a storage space for storing food; a plurality of shelves vertically dividing the storage space, formed flat to place food, and sliding in/out in parallel, with the tops in the same plane; holders attached to the rear wall of the inner case, where the rear ends of the shelves are detachably connected such that adjacent shelves turn toward each other, a first pressing portion formed at the front of any one of the shelves to push the adjacent shelf; and a second pressing portion formed at the front of the shelf adjacent to any one of the shelves, contacting the first pressing portion, and pushing the first pressing portion, in which the distances between the front ends and the rear ends of two adjacent shelves are the same by the first pressing portion and the second pressing portion pushing each other.

According to a refrigerator of an embodiment of the present invention, there is not difference in a plurality of shelves arranged continuously in parallel with each other.

Further, the food on the shelves is not inclined.

Further, since an adjacent shelf does not interfere with the other shelf sliding in/out, it is possible to easily keep the food.

Further, since the shelves are aligned, the aesthetic appearance is improved and the users' satisfactory for the product is improved.

DETAILED DESCRIPTION OF THE EMBODIMENTS

Detailed embodiments for implementing the spirit of the present invention is described hereafter in detail with the accompanying drawings.

Figure 1:
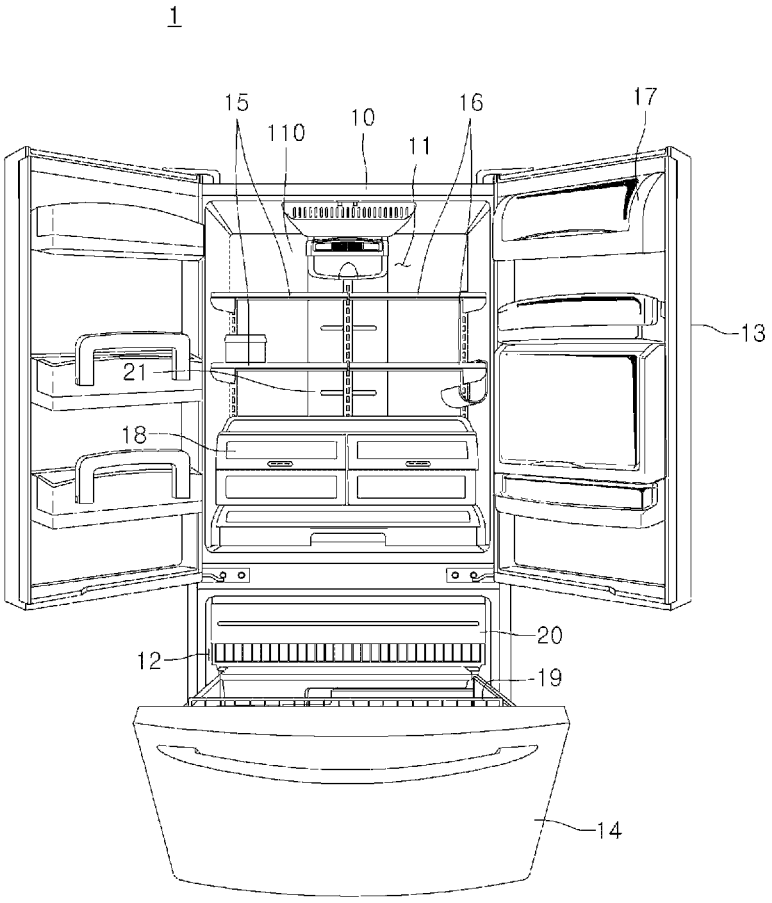
FIG. 1 is a perspective view showing the inside of a refrigerator according to an embodiment of the present invention.

FIG. 1 is a perspective view showing the inside of a refrigerator according to an embodiment of the present invention.

Hereinafter, a 3-door bottom freeze type of refrigerator is exemplified to explain the spirit of the present invention. However, it should be understood that the spirit of the present invention is not limited to the 3-door bottom freeze type of refrigerator shown in the drawings and may also be applied to a tom mount type of refrigerator with the freezing compartment at the upper portion and a side-by-side type of refrigerator with the cold compartment and the freezing compartment at both sides.

Referring to FIG. 1, a refrigerator 1 according to the present invention includes: a body 10 defining the external shape; an inner case 110 defining the inner sides of the body 10 and a storage space for storing food; a cold compartment 11 keeping the food in cold storage at the upper portion of the storage space; and a freezing compartment 12 keeping the food in freezing storage at the lower portion of the storage space. Further, cold compartment doors 13 pivoted to selectively open/close the cold compartment 11 are connected to both side ends of the front of the body 10. Further, a freezing compartment door 14 is pivotably connected to the lower end of the body 10 to selectively open/close the freezing compartment 12.

In detail, a plurality of baskets containing food requiring independent space, such as milk and cheese, is mounted on the rear of the cold compartment doors 13.

Further, a plurality of shelves 15, 16 where food is placed is provided in the cold compartment 11. In detail, the shelves 15, 16 are composed of left shelves 15 and right shelves 16, in which the left shelves 15 and the right shelves 16 are transversely arranged in parallel at predetermined heights, respectively.

Further, a plurality of boxes 18 storing vegetables are provided under the shelves 15.

In this configuration, a cold air duct 21 guiding cold air produced from an evaporator (not shown) into the cold compartment 11 is provided at the center of the cold compartment 11. The cold air duct 21 vertically extends from a cold are generating chamber where the evaporator is positioned to the top of the cold compartment 11. A plurality of cold air holes is formed through the cold air duct 21 to smoothly discharge the cold air into the cold compartment 11.

Meanwhile, the freezing compartment door is sized such that it covers the entire front of the freezing compartment 12. Further, a main drawer 19 having a relatively large food storage space and a sub-drawer 20 having a relatively small food storage space are provided in the cold compartment 12. Further, the freezing door 14 is pivotably connected to the front of the main drawer 19.

According to the configuration described above, users can easily put in/out food and efficiently use the space in the refrigerator.

Figure 2:
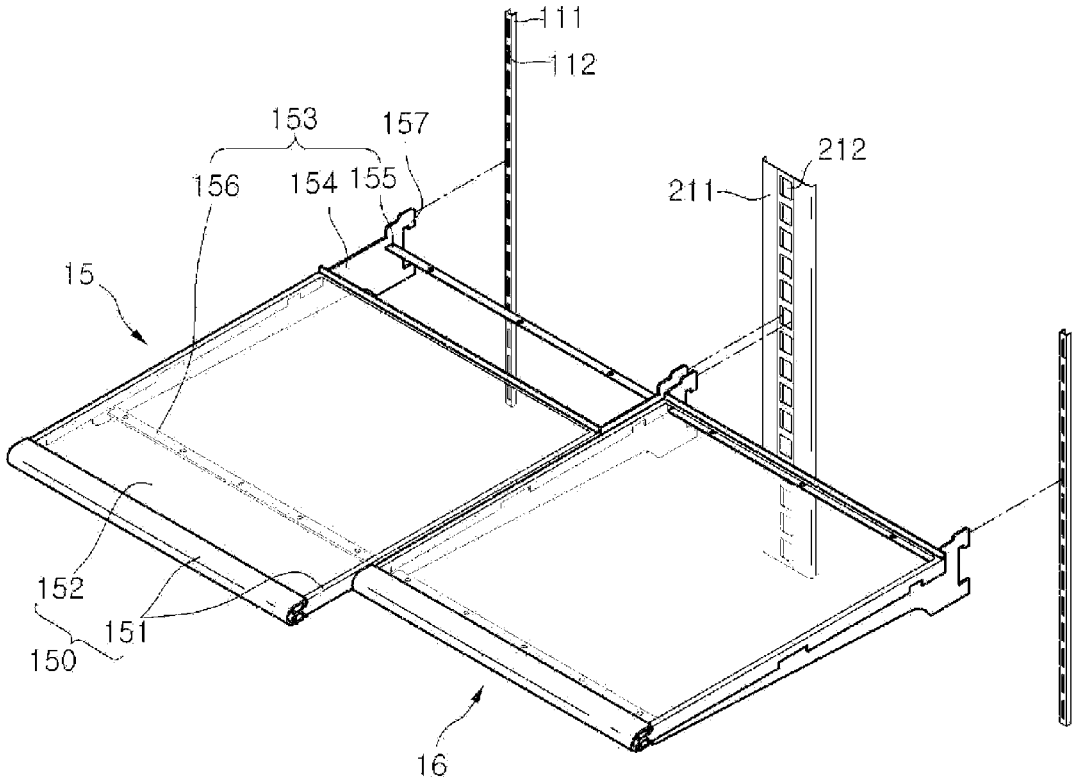
FIG. 2 is an exploded perspective view showing when shelves are combined with the main body of FIG. 1.

FIG. 2 is an exploded perspective view showing when shelves are combined with the main body of FIG. 1.

Referring to FIG. 2, the left shelf 15 is composed of a shelf plate 150 where food is placed and a support assembly 153 that guides the shelf plate 150 sliding forward/backward.

In detail, the shelf plate 150 is composed of a shelf surface 152 where food is placed and an border covering the edge of the shelf surface 152. The shelf surface 152 may be made of transparent glass to easily show the food in the refrigerator. Both sides of the border 151 at least bend down to slide on the support assembly 153 and may have a stopper (not shown) to restrict the sliding.

The support assembly 153 is composed of support frames 154 that guide the shelf plate 150 sliding forward, under both sides of the border 151, a support part 155 connecting the support frames 154, and a stopping bar 156 stopping the stopper of the shelf plate 150, close to the front of the support frames 154.

In detail, the support frames 154 is formed in a plate shape longitudinally extending and have connecting portions 157 at the rears. The upper portion of the connecting portion 157 has a hook shape and the lower portion is a protrusion. Further, the connecting portion 157 is inserted in connecting grooves 112, 212, which are described below. In this structure, the upper and lower portions of the connecting portion 157 are fitted in different grooves. Further, even if a user lifts up the front of the left shelf 15, the left shelf 15 keep the position, because the upper portions of the connecting portions 157 are formed in hook shapes and locked in the connecting grooves 112, 212.

Further, the connecting portions 157 are connected to a side holder 111 and a center holder 211 mounted on the rear wall of the cold compartment 111. In detail, the side holder 111 vertically extends at the left side and right side of the rear wall of the cold compartment 11. Further, the center holder 211 vertically extends at the center of the cold air duct 21. The connecting grooves 112, 212 where the connecting portions 157 are fitted are vertically and continually formed through the holders 111, 211.

In this configuration, the center connecting grooves 212 may have a larger width than the side connecting grooves 112, because the connecting portions 157 of two shelves are fitted. Further, the center holder 211 is positioned closer to the rear wall of the cold compartment 11, as compared with the side holders 111. That is, the center holder 211 is positioned behind the side holders 111. This is described in detail below.

Further, the configuration of the right shelf 16 is the same as the left shelf 15 and refers to the description for the left shelf 15 without providing the detailed description.

According to the configuration described above, users can freely slide in/out the shelf plate 150. Further, it is possible to adjust the heights of the left shelves 15 by separating the left shelves 15 from the holders 111, 211 and fitting in the connecting grooves 112, 212 at desired heights. This is the same as the right shelves 16.

Figure 3:
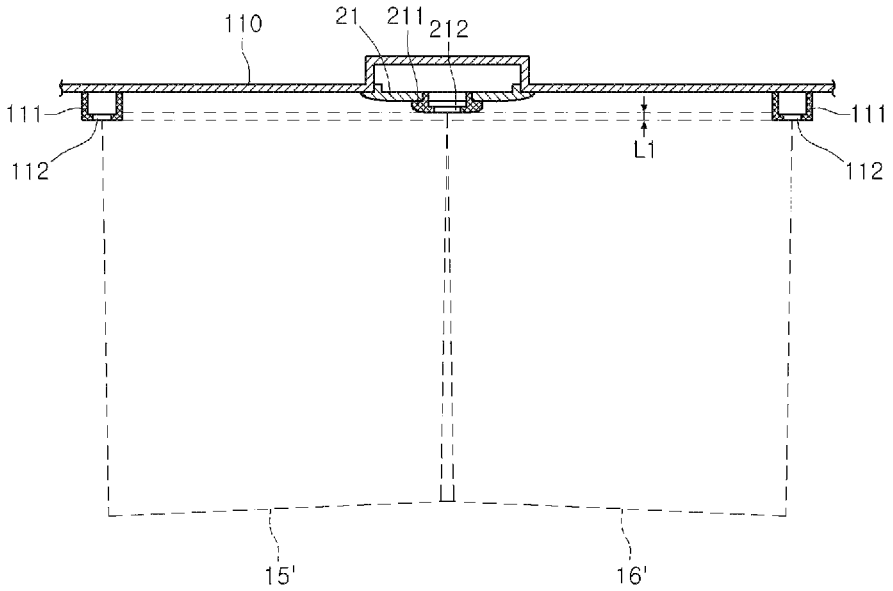
FIG. 3 is a transverse cross-sectional view showing when a side holder and a center holder of FIG. 1 are combined with an inner case.

FIG. 3 is a transverse cross-sectional view showing when a side holder and a center holder of FIG. 1 are combined with an inner case.

Referring to FIG. 3, the side holders 111 is mounted at both sides of the inner case 110 defining the rear wall of the cold compartment 11. The side holders 111 may protrude at a predetermined length from the inner case 110 and the side connecting grooves 112 where the connecting portions 157 are fitted are formed in through the fronts of the side holders 111.

Further, the cold air duct 21 is provided at the center portion of the inner case 110. The center holder 211 is mounted at the center portion of the cold air duct 21 and the center connecting grooves 212 are formed through the front to correspond to the side connecting grooves 112.

In this configuration, the front of the center holder 211 is closer to the inner case 110 than the fronts of the side holder 111. That is, the center connecting grooves 112 are positioned behind the side connecting grooves 112. In other words, there is a difference L1 between the distance to the center connecting grooves 212 and the distance to the side connecting grooves 112 from the rear wall of the inner case 110.

Since the center connecting grooves 212 are formed at more rear position, as described above, the fronts 15', 16' of the shelves collect to the center, as shown in the dotted lines, when the left shelf 15 and the right shelf 16 are fitted in the connecting grooves 112, 212, respectively. In other words, the gap between the rear ends is smaller than the gab between the front ends in adjacent shelves. That is, a gap difference is forcibly formed between adjacent shelves by making the position of the connecting grooves 112, 212 different.

In this configuration, the degree of collection to the center is proportionate to L1. Therefore, an interference region may be formed between the shelves 15', 16' inclining in accordance with L1. In this embodiment, it is exemplified that the shelves 15, 16 are inclined at a predetermined angle such that the distance between the front ends of the shelves 15, 16 is smaller at several millimeters than the distance between the rear ends.

Figure 4:
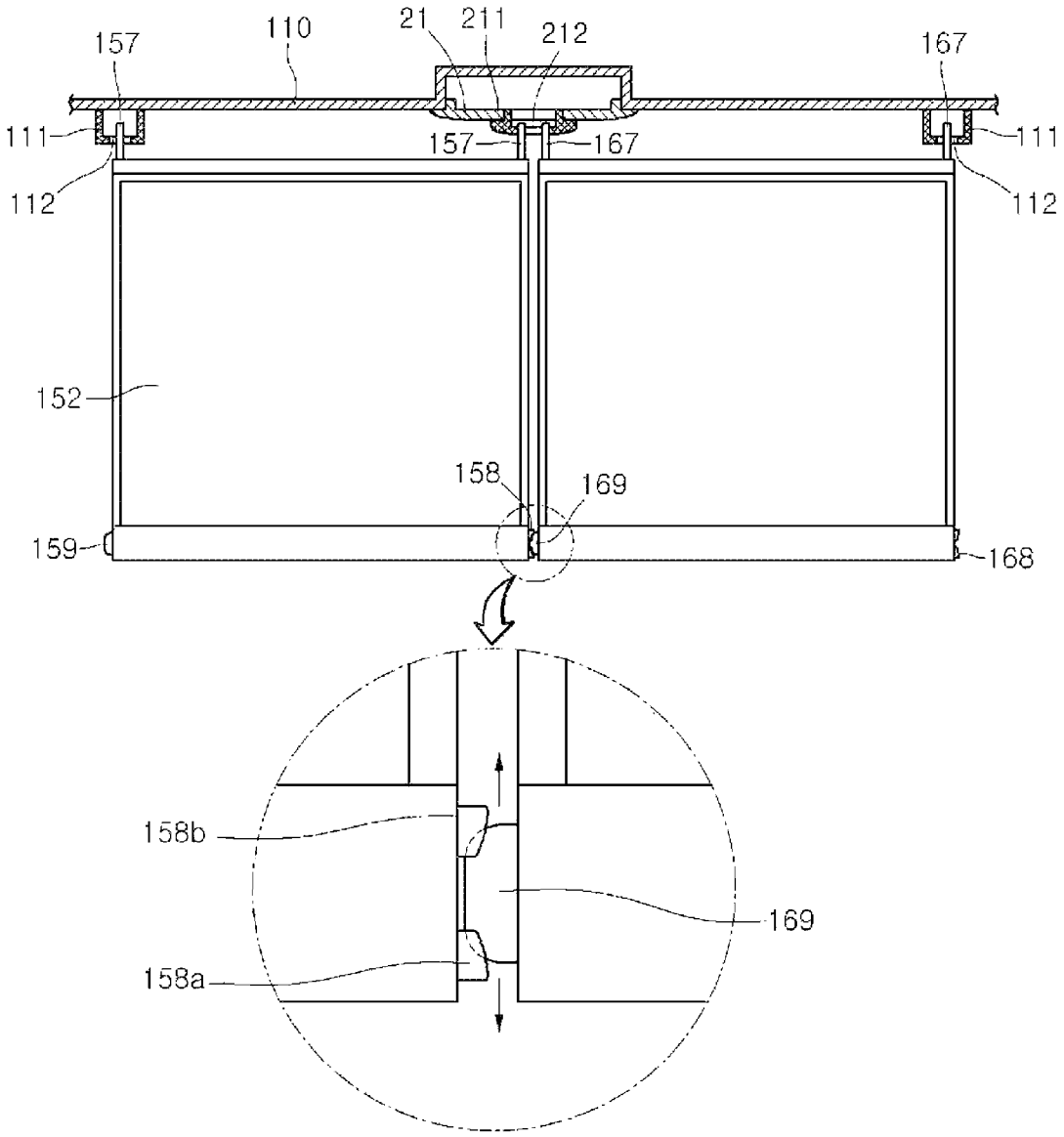
FIG. 4 is a view showing when shelves are combined with side holder and the center holder of FIG. 3.
Figure 5:
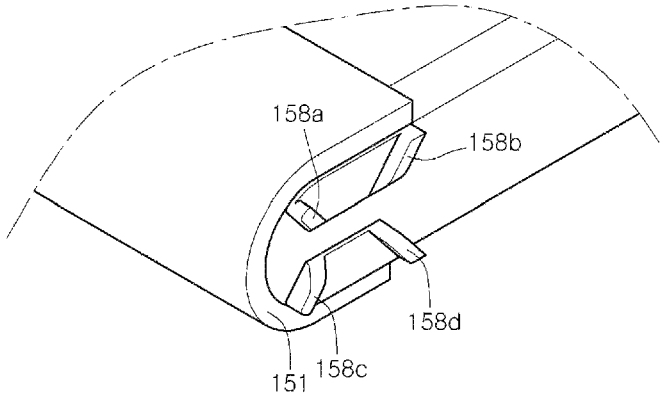
FIG. 5 is a view showing a first pressing portion of the left shelf of FIG. 4.
Figure 6:
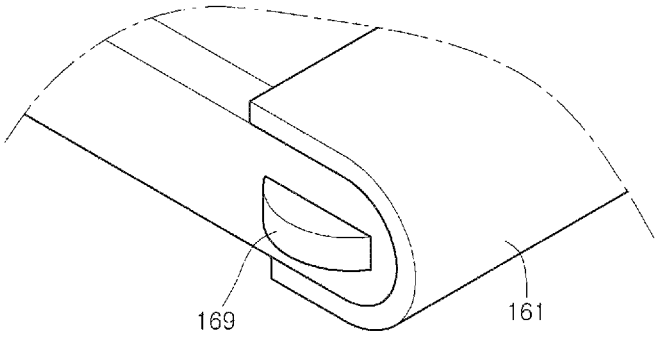
FIG. 6 is a view showing a second pressing portion of the right shelf of FIG. 4.
Figure 7:
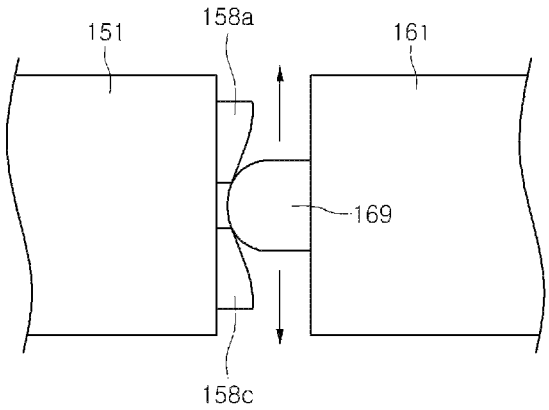
FIG. 7 is a front view showing when the first pressing portion of the left shelf is combined with the second pressing portion of the right shelf.

FIG. 4 is a view showing when shelves are combined with side holder and the center holder of FIG. 3, FIG. 5 is a view showing a first pressing portion of the left shelf of FIG. 4, FIG. 6 is a view showing a second pressing portion of the right shelf of FIG. 4, and FIG. 7 is a front view showing when the first pressing portion of the left shelf is combined with the second pressing portion of the right shelf.

Referring to FIGS. 4 to 7, the connecting grooves 112, 212 are formed such that a gap difference is formed between the left shelf 15 and the right shelf 16, but the tops and front ends of the left shelf 15 and the right shelf 16 are aligned.

In detail, since the center connecting grooves 212 are positioned behind the side connecting grooves 112, the left shelf 15 turns right from the holders 111, 211 and the right shelf 16 turns left from the holders 111, 211. That is, the shelves 15, 16 are combined such that the front ends collect to the center.

Further, a first pressing portion 158 is formed at the right side of the front end of the left shelf 15 and a second pressing portion 169 is formed at the left side of the front end of the right shelf 16 to correspond to the first pressing portion 158. The first pressing portion 158 and the second pressing portion 169 face each other to pressing each other.

Further, the first pressing portion 158 and the second pressing portion 169 are formed at corresponding positions such that the tops of the shelves 15, 16 are positioned in the same plane and the front corners of the shelves 15, 16 are in the same line, when the first pressing portion 158 and the second pressing portion 169 are combined.

In detail, the second pressing portion 169 is fitted in a predetermined groove formed at the first pressing portion 158. The predetermined grooves are formed by protrusions 158*a*, 158*b*, 158*c*, 158*d*, which are described below. Since the left shelf 15 and the right shelf 16 turn to each other, the first pressing portion 158 and the second pressing portion 169 naturally apply force to each other, such that the first pressing portion 158 and the second pressing portion 169 are more firmly combined.

Further, the first pressing portion 158 and the second pressing portion 169 are formed at the front ends of the shelves 15, 16. Therefore, the first pressing portion 158 and the second pressing portion 169 push each other such that the gap between the front ends of the shelves 15, 16 corresponds to the gap between the rear ends of the shelves 15, 16; therefore, it is possible to prevent a gap difference between the shelves 15, 16.

The first pressing portion 158 may be composed of a plurality of radially protruding protrusions. The protrusions may be formed in an X-shape radially from the center of the first pressing portion 158.

It is exemplified in this embodiment that the first pressing portion 158 is composed of four protrusions. In detail, the first protrusion 158*a* and the third protrusion 158*c* are formed at the front portion and the second protrusion 158*b* and the fourth protrusion 158*d* are formed at the rear portion, from the center of the first pressing portion 158. Further, the first protrusion 158*a* and the third protrusion 158*c* are positioned at the upper portion and the second protrusion 158*b* and the fourth protrusion 158*d* are positioned at the lower portion, from the center of the first pressing portion 158. In addition, the protrusions extend radially from the center of the first pressing portion 158.

Further, the farther from the center, the more the protrusions 158*a*, 158*b*, 158*c*, 158*d* may increase. That is, the first pressing portion 158 has a smaller height at the center than the edges.

For example, the first protrusion 158*a* may increase in height toward the outer end and toward the upper portion. Further, the third protrusion 158*c* may increase in height toward the outer end, similar to the first protrusion 158*a*, and toward the lower portion. The second protrusion 158*b* and the fourth protrusion 158*d* may be formed in the same way as the first protrusion 158*a* and the third protrusion 1558*c*. Further, the protrusions 158*a*, 158*b*, 158*c*, 158*d* may have the ends rounded such that the second protrusion 169 can easily move.

Further, the protrusions 158*a*, 158*b*, 158*c*, 158*d* may be spaced apart from each other such that the second protrusion 169 can easily move. That is, the second protrusion 169 may be combined with or separated from the first pressing portion 158 while moving along the spaces formed between the protrusions 158*a*, 158*b*, 158*c*, 158*d*.

In this configuration, the vertical distance between the protrusions 158*a*, 158*b*, 158*c*, 158*d* may correspond to the vertical length of the second protrusion 169. For example, the vertical distance between the protrusions 158*a*, 158*b*, 158*c*, 158*d* may be smaller than the vertical length of the second protrusion 169. In this case, the second protrusion 169 is fitted in the first pressing portion 158 at a predetermined distance from the right side of the left shelf 16.

Meanwhile, the second pressing portion 169 is positioned with the center corresponding to the first pressing portion 158 and protrudes toward the first pressing portion 158. Further, the second pressing portion 169 extends in the front-rear direction and positioned in a space defined by the protrusions 158*a*, 158*b*, 158*c*, 158*d*. Further, the second pressing portion 169 can be in simultaneous contact to the central ends of the protrusions 158*a*, 158*b*, 158*c*, 158*d*, when the shelves 15, 16 are mounted.

Further, at least a portion of the second pressing portion 169 is sized such that they can be retained by the protrusions 158*a*, 158*b*, 158*c*, 158*d*. That is, since the protrusions 158*a*, 158*b*, 158*c*, 158*d* further protrude toward outside, at least a portion of the second pressing portion 169 may have a shape corresponding to the protrusions 158*a*, 158*b*, 158*c*, 158*d* such that it is kept fitted in the center of the first pressing portion 158. In other words, the second pressing portion 169 interferes with the protrusions 158*a*, 158*b*, 158*c*, 158*d*, when being combined with the first pressing portion 158. Therefore, it is possible to keep the second pressing portion in the first pressing portion 158.

Further, the second pressing portion 169 may be rounded to easily move along the protrusions 158*a*, 158*b*, 158*c*, 158*d*.

Meanwhile, the first pressing portion 158 and the second pressing portion 169 protrude such that the distance between the rear ends is the same as the distance between the front ends of the shelves 15, 16. That is, the shelves 15, 16 are connected to the holders 111, 211 such that the gap difference when the distance between the front ends is smaller than the distance between the rear ends is structurally defined; however, the distance between the front ends may be the same as the distance between the rear ends by fitting the second pressing portion 169 in the first pressing portion 158. This configuration can be achieved by adjusting the protrusion height of the first pressing portion 158 or the protrusion height of the second pressing portion 169.

Further, a pressing portion 159 corresponding to the second pressing portion 169 may be formed at the left side of the left shelf 15 and a pressing portion 168 corresponding to the first pressing portion 158 may be formed at the right side of the right shelf 16. Therefore, it is possible to achieve the same effect even if the left shelf 15 and the right shelf 16 are switched to the holders 111, 211.

Hereinafter, it is described that the second pressing portion is combined with the first pressing portion 158.

When the second pressing portion 169 is combined with the first pressing portion 158, the second pressing portion 169 is positioned in the space defined by the protrusions 158*a*, 158*b*, 158*c*, 158*d*, that is, the center of the first pressing portion 158.

Further, the second pressing portion 169 is retained by the protrusions 158*a*, 158*b*, 158*c*, 158*d*. In detail, since the protrusions 158*a*, 158*b*, 158*c*, 158*d* are spaced apart from each other, a predetermined space is defined at the center. Further, since the protrusions 158*a*, 158*b*, 158*c*, 158*d* further protrude toward the outside, the central ends of the protrusions 158*a*, 158*b*, 158*c*, 158*d* form the space at the center where the second pressing portion 169 is fitted.

Further, the second pressing portion 169 is combined with the first pressing portion 158 by being fitted in the space formed by the protrusions 158*a*, 158*b*, 158*c*, 158*d*.

Further, since the first pressing portion 158 and the second pressing portion 169 are formed such that the distance between the rear ends is the same as the distance between the front ends of the shelves 15, 16, the gap difference may be removed.

Further, since the second pressing portion 169 is combined with the first pressing portion 158, with the tops of the shelves 15, 16 in the same plane, the height difference can be removed, and the front corners of the shelves 15, 16 are positioned in the same line; therefore, the front-rear difference can be removed.

In this configuration, since the shelves 15, 16 is arranged with the front ends structurally turn to the center, the combination between the first pressing portion 158 and the second pressing portion 169 can be firmly maintained with a little interference. In detail, the shelves 15, 16 should be firmly combined to remove the difference and the force is applied to the shelves 15, 16 toward the center; therefore, the combination of the shelves 15, 16 can be maintained by the force toward the center even if the interference is small between the first pressing force 158 and the second pressing force 169.

Hereinafter, a process of sliding in/out the shelves 15, 16 having the above configuration is described.

The shelf plate 150 of the left shelf 15 can slide forward/backward, independently from the right shelf 16. Therefore, the first pressing portion 158 and the second pressing portion 169 should be separated to draws out the shelf plate 150.

In detail, when a user draws out the shelf plate 150, the first pressing portion 159 moves forward. In the operation, the second pressing portion 169 maintains the position. That is, the force fixing the shelf plate of the right shelf to the support assembly should be larger than the combination force between the first pressing portion 158 and the second pressing portion 169.

As the shelf plate 150 moves forward, the second protrusion 158*b* and the fourth protrusion 158*d* moves forward, passing the second pressing portion 169. That is, the second pressing portion 169 can move along the space formed between the second protrusion 158*b* and the fourth protrusion 158*d*. The second protrusion 158*b* and the fourth protrusion 158*d* radially extend and are rounded; therefore, the first pressing portion 158 and the second pressing portion 169 can be easily separated. Further, since it is possible to design such that the interference is small between the first pressing portion 158 and the second pressing portion 169, they can be easily separated.

Further, when the user draws in the shelf plate 150, the second pressing portion 169 is fitted in the first pressing portion 158 along the space between the second protrusion 158*b* and the fourth protrusion 158*d*, such that the first pressing portion 158 and the second pressing portion 169 are combined again.

Meanwhile, when the user draw out the shelf plate of the right shelf 16, the first pressing portion 158 and the second pressing portion 169 are separated and the second pressing portion 169 moves forward along the space between the first protrusion 158*a* and the third protrusion 158*c*. In the operation, the first pressing portion 158 maintains the position.

The first protrusion 158*a* and the third protrusion 158 also radially extend and are rounded; therefore, the second pressing portion 169 can be easily separated from the first pressing portion.

Meanwhile, when the user draw in the shelf plate of the right shelf 16, the second pressing portion 169 is fitted in the space between the first protrusion 158*a* and the third protrusion 158*c*, and the first pressing portion 158 and the second pressing portion 169 are combined again.

Further, the user lifts up the left shelf 15 to separate the left shelf 15 from the holders 111, 211, in order to adjust the height of the left shelf 15. In the operation, the second pressing portion 169 keep the position, and the third protrusion 158*c* and the fourth protrusion 158*d* moves upward from the second pressing portion 169. This operation is similar to putting in/out the shelf plate 150, except for the movement direction of the first pressing portion 158, such that the detailed description is not provided.

Further, when the user adjusts the height of the right shelf 16, the second pressing portion 1 69 moves with the first pressing portion 158 keeping the position, which is also the same as that described above.

Meanwhile, the first pressing portion 158 may be called a receiving portion because it receives the second pressing portion 169 and the second pressing portion 169 may be called as a protrusion because it is fitted in the first pressing portion 158.

Further, the positions of the first pressing portion 158 and the second pressing portion 169 may be changed.

According to the refrigerator 1 of an embodiment of the present invention described above, it is possible to remove the gap difference, front-rear difference, and vertical difference in the shelves 15, 16.

Further, the combination between the shelves 15, 16 is firmly maintained and it is possible to conveniently keep food without inclination by removing the differences.

Further, since the shelves 15, 16 smoothly and independently slide in/out and the differences are removed, users' satisfactory for the product is increased.

The spirit of the present invention is not limited to the above embodiment and the embodiment can be changed, added, and removed without the spirit of the present invention.

What is claimed is:

1. A refrigerator comprising:

a body having a storage space for keeping food at low temperature;

a door movably attached to the body to selectively open and close the storage space;

a first shelf movably provided in the storage space and having a first side surface;

a second shelf movably provided in the storage space next to the first shelf and having a second side surface which faces the first side surface of the first shelf;

a first pressing portion including a plurality of protrusions formed on the first side surface of the first shelf;

a second pressing portion formed on the second side surface of the second shelf and facing the first pressing portion, wherein the plurality of protrusions includes:

a front protrusion part, comprising:

a first protrusion; and a second protrusion below the first protrusion; and a rear protrusion part, comprising:

a third protrusion rearwardly spaced away from the first protrusion; and a fourth protrusion rearwardly spaced away from the second protrusion, wherein a space between the first and third protrusions and the second and fourth protrusions is defined such that the second pressing portion moves forward or rearward along the space when one of the first and second shelves slides forward or rearward, wherein the first and third protrusions extend downwardly from an upper end of the first side surface, wherein the second and fourth protrusions extend upwardly from a lower end of the first side surface, and wherein the first and second protrusions are rearwardly inclined in such a manner that a distance between front ends of the first and second protrusions is larger than a distance between rear ends of the first and second protrusions, so that the second pressing portion is guided to a center of the first pressing portion.

2. The refrigerator of claim 1, wherein the third and fourth protrusions are forwardly inclined in such a manner that a distance between front ends of the third and fourth protrusions is smaller than a distance between rear ends of the third and fourth protrusions, so that the second pressing portion is guided to the center of the first pressing portion.

3. The refrigerator of claim 2, wherein when the first and second shelves are installed in the storage space, a portion of the second pressing portion is in simultaneous contact with lower parts of the first and third protrusions and upper parts of the second and fourth protrusions, such that the second pressing portion is fitted in the center of the first pressing portion.

4. The refrigerator of claim 2, wherein outer surfaces of the first and second protrusions that the second pressing portion contacts when the second pressing portion moves rearward are rounded to allow the second pressing portion to easily move rearward.

5. The refrigerator of claim 2, wherein outer surfaces of the third and fourth protrusions that the second pressing portion contacts when the second pressing portion move forward are rounded to allow the second pressing portion to easily move forward.

6. The refrigerator of claim 2, wherein a protruding distance of the first pressing portion from the first side surface is less towards the center of the first pressing portion.

7. The refrigerator of claim 2, wherein each of the first and second shelves includes:

a support assembly attached to a rear wall of the storage space; and a shelf plate that is slidable along the support assembly and includes the first or second side surface.

8. The refrigerator of claim 2, wherein the second pressing portion protrudes from the second side surface of the second shelf.

9. The refrigerator of claim 8, wherein an end of the second pressing portion is rounded so that the second pressing portion moves smoothly to be fitted in or separated from the first pressing portion.

* * * * *